United States Patent [19]

Chitty et al.

[11] Patent Number: 5,062,518

[45] Date of Patent: Nov. 5, 1991

[54] COIN VALIDATION APPARATUS

[75] Inventors: Clive L. Chitty; Roger W. Whatmore, both of Northants, England

[73] Assignee: GEC Plessey Telecommunications Limited, Coventry, England

[21] Appl. No.: 420,188

[22] Filed: Oct. 12, 1989

[30] Foreign Application Priority Data

Sep. 20, 1988 [GB] United Kingdom ..... 8822115

[51] Int. Cl.[5] ..... G07D 5/04

[52] U.S. Cl. ..... 194/317; 194/339; 177/211

[58] Field of Search ..... 194/317, 327, 339; 177/211

[56] References Cited

U.S. PATENT DOCUMENTS

| | | | |
|---|---|---|---|
| 2,317,351 | 4/1943 | Andalikiewicz et al. | 194/347 X |
| 4,096,933 | 6/1978 | Massa | 194/327 |
| 4,848,556 | 7/1989 | Shah et al. | 194/212 |

FOREIGN PATENT DOCUMENTS

| | | | |
|---|---|---|---|
| 0645201 | 9/1984 | Switzerland | 194/327 |
| 0656240 | 6/1986 | Switzerland | 194/317 |
| 2200778 | 8/1988 | United Kingdom | 194/317 |

*Primary Examiner*—F. J. Bartuska

*Attorney, Agent, or Firm*—Fleit, Jacobson, Cohn, Price, Holman & Stern

[57] ABSTRACT

Coin validation apparatus having a coin chute including a hard striking surface upon which a coin entering the apparatus is directed. A microphone is positioned to detect acoustic vibrations of the coin after it strikes the striking surface. An output from the microphone is applied to a fast fourier transform device to produce a signal analysis of the coin vibration. A weighbridge measuring apparatus which is made up of a flexible strip of resilient material carried on a support at each end is provided. The coin rolls across the flexible strip to cause a temporary deflection of a center portion of the strip. A strain gauge located at the strip center to produce an electrical signal representative of the deflection. A classifier compares the signal analysis and the strain gauge signal with stored data representative of a set of standard coins, for classifying the coin as a particular coin value.

11 Claims, 12 Drawing Sheets

2P - 100kHz SPECTRUM AND TIME RECORD

2P - 10kHz-60kHz (EXPANDED) SPECTRUM AND TIME RECORD

COIN VALIDATION APPARATUS

Figure 1:
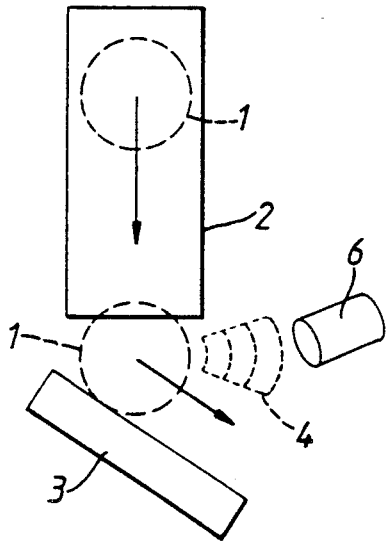

This invention relates to coin validation apparatus. It relates particularly to apparatus and a method which is applicable to detecting the values of coins dropped into a slot, and therefore it may be used in a vending machine, a telephone coin box, a coin sorting machine or other suitable device where there is a need to check the values of incoming coins inserted by a potential customer or user.

According to the invention, there is provided a method of validating a coin entering coin validation apparatus, the method comprising the steps of providing a coin chute arranged for directing the entering coin onto a hard striking surface, detecting acoustic vibrations emitted by the said coin upon striking said surface, converting said vibrations to corresponding electric signals, processing said signals to measure the intensity of sound emitted in each one of a series of predetermined frequency bands, obtaining additional data from a weight and/or shape measuring apparatus comprising a flexible strip of resilient material which is carried on a support at each end, providing a strain gauge on said strip effective to produce an electrical signal representative of the deflection which is induced in the strip, comparing the resulting vibration spectrum with stored data representative of a set of standard coins, and indicating which value of coin corresponds to that having entered said apparatus.

The invention also comprises coin validation apparatus comprising a coin chute including a hard striking surface upon which a coin entering the apparatus is directed, a microphone positioned to detect acoustic vibrations of the coin after striking said surface, an output from said microphone being applied to signal processor means to produce a dynamic signal analysis of the coin vibrations, obtaining additional data from a weight and/or shape measuring apparatus comprising a flexible strip of resilient material which is carried on a support at each end, guide means for permitting the said coin to be rolled along the whole length of the strip thereby causing a temporary deflection of a centre portion of said strip, and a strain gauge located at the strip centre portion effective to produce an electrical signal representative of the deflection which is induced in the strip, comparison means for enabling the resulting vibration spectrum and electrical signal to be compared with stored data representative of a set of standard coins, and output means arranged to indicate which coin value of the expected coin set has entered the apparatus.

In one embodiment, the said strain gauge is a piezoelectric sensor. The two strip supports may be located at opposite ends of an enclosure defining a cavity having a sufficient depth to accommodate the said strain gauge. The cavity may contain a mechanical damping medium arranged to reduce unwanted flexural resonances in said strip. The damping medium may be a grease, such as a silicone or hydrocarbon-based grease, a gel or a rubber.

Figure 9:
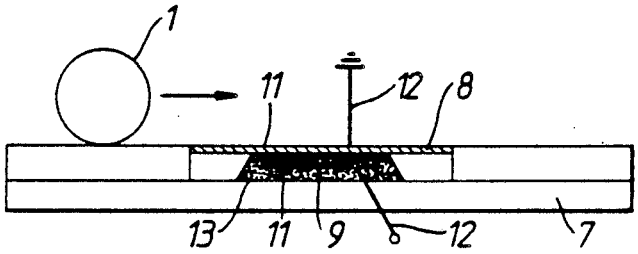
Figure 2:
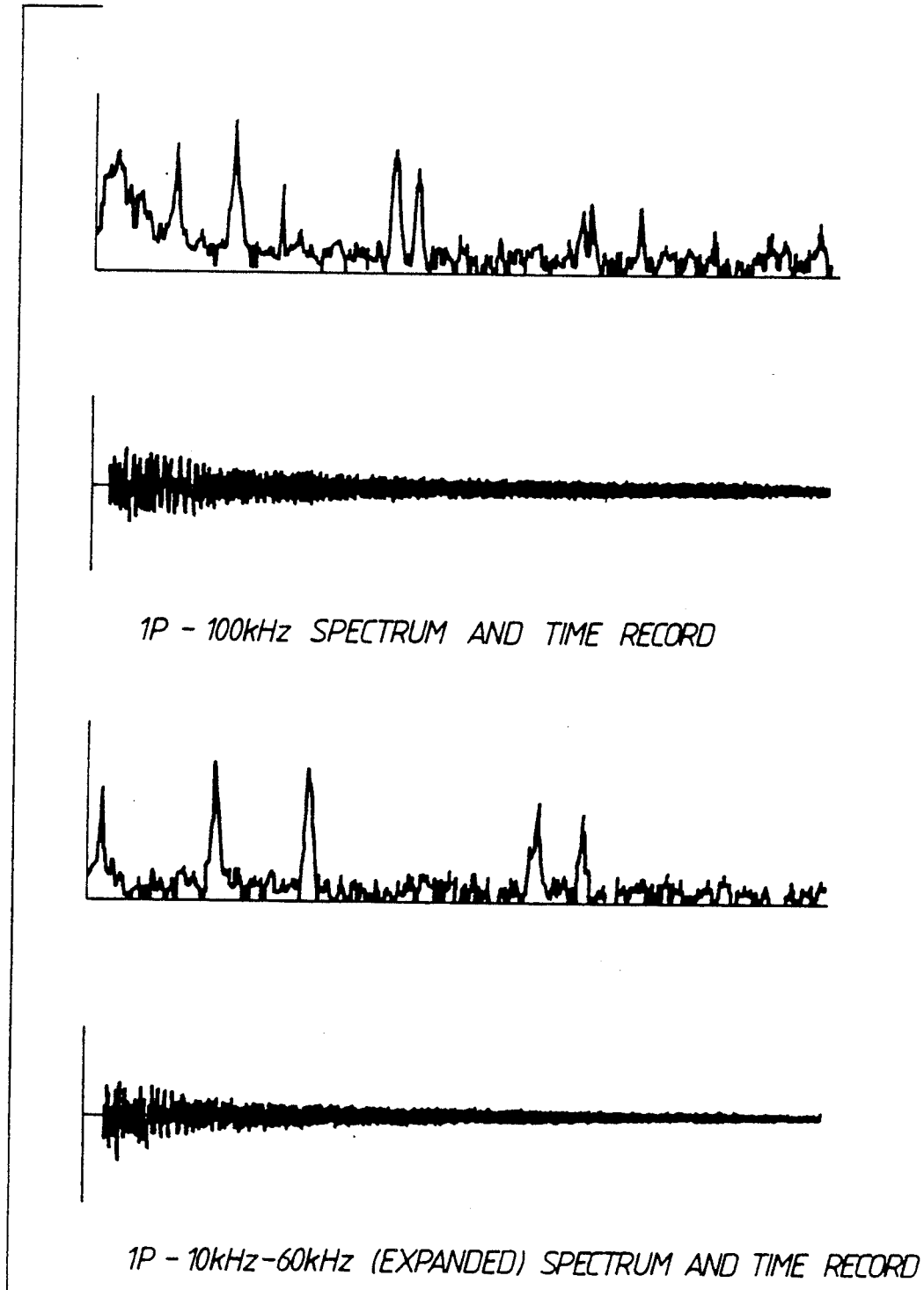
Figure 3:
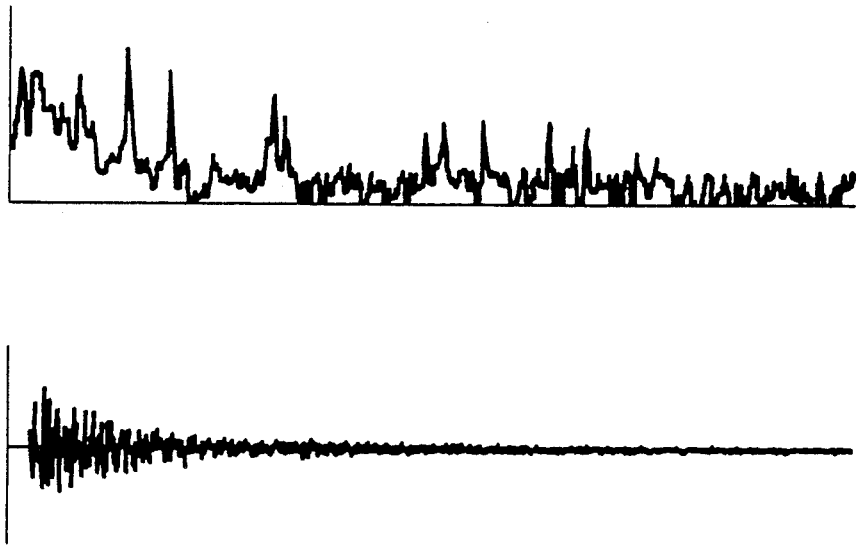
Figure 3:
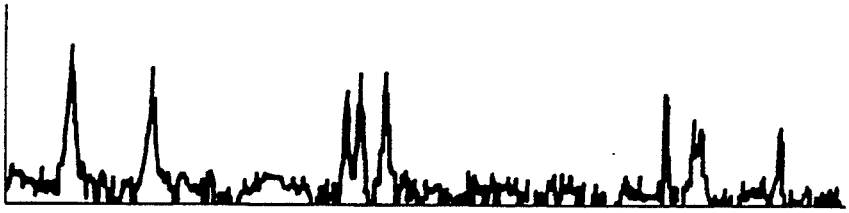
Figure 3:
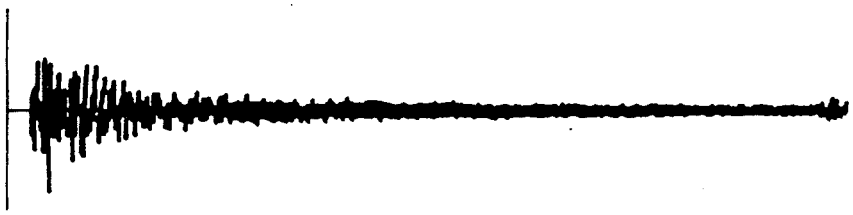
Figure 4:
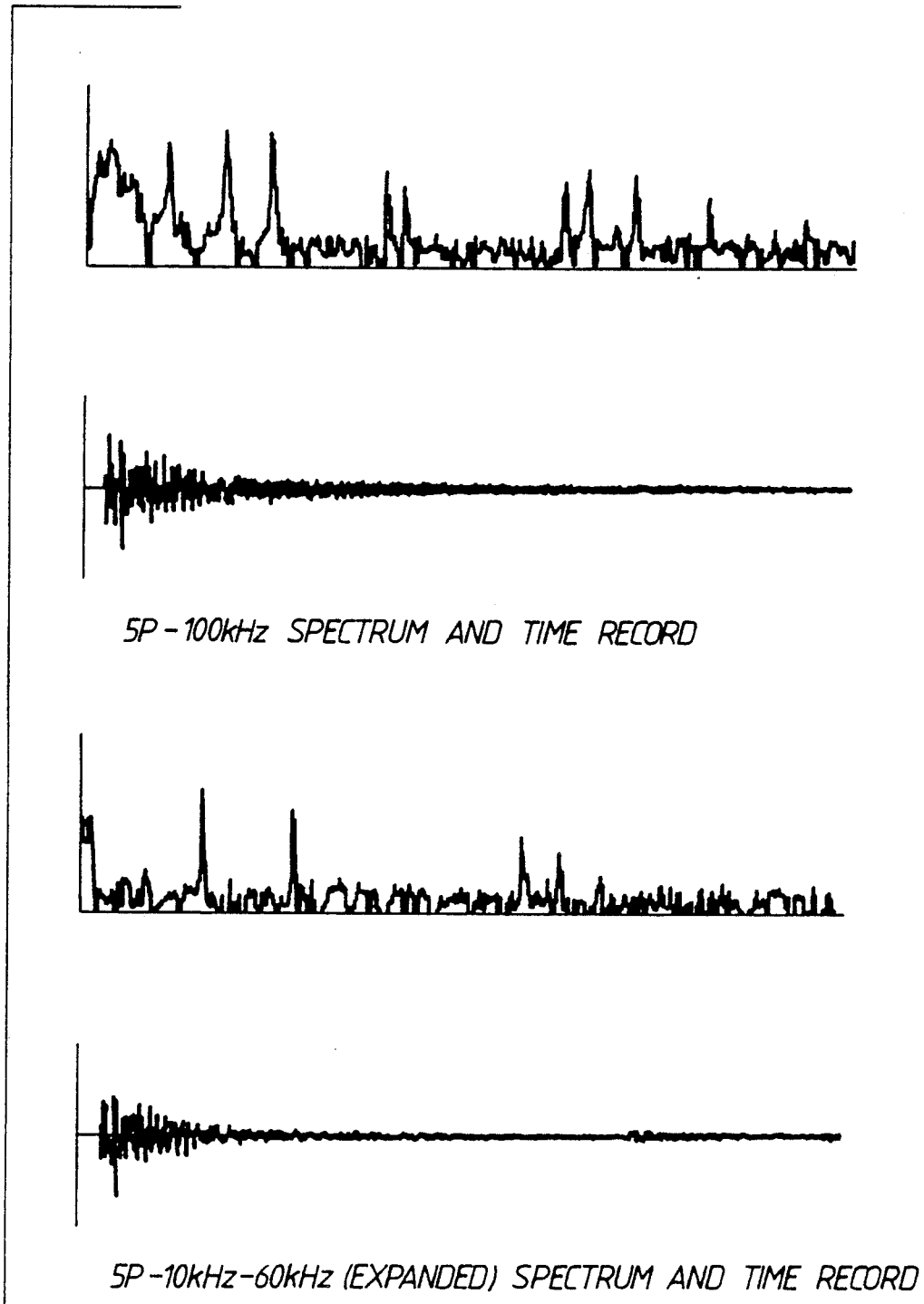
Figure 5:
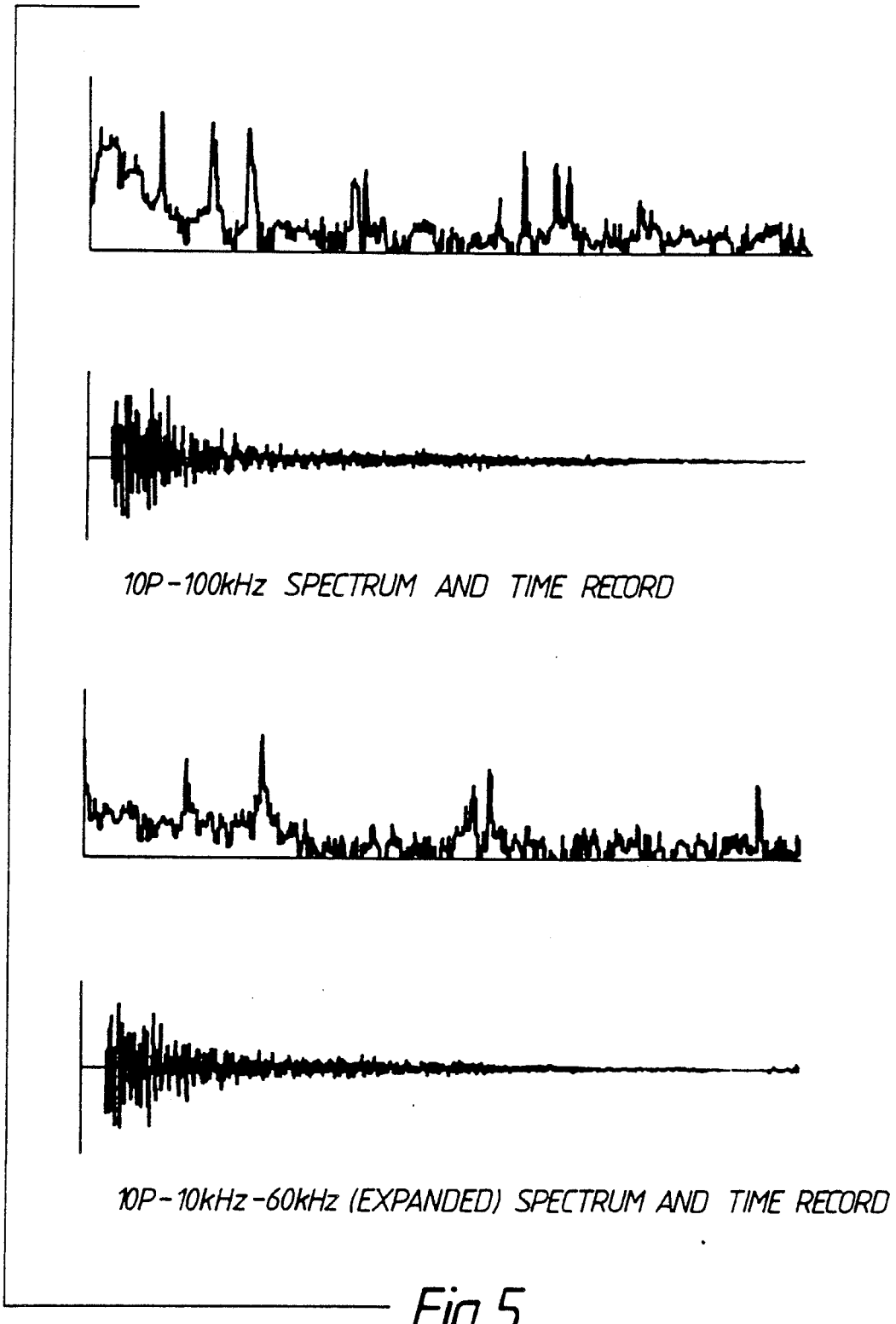
Figure 6:
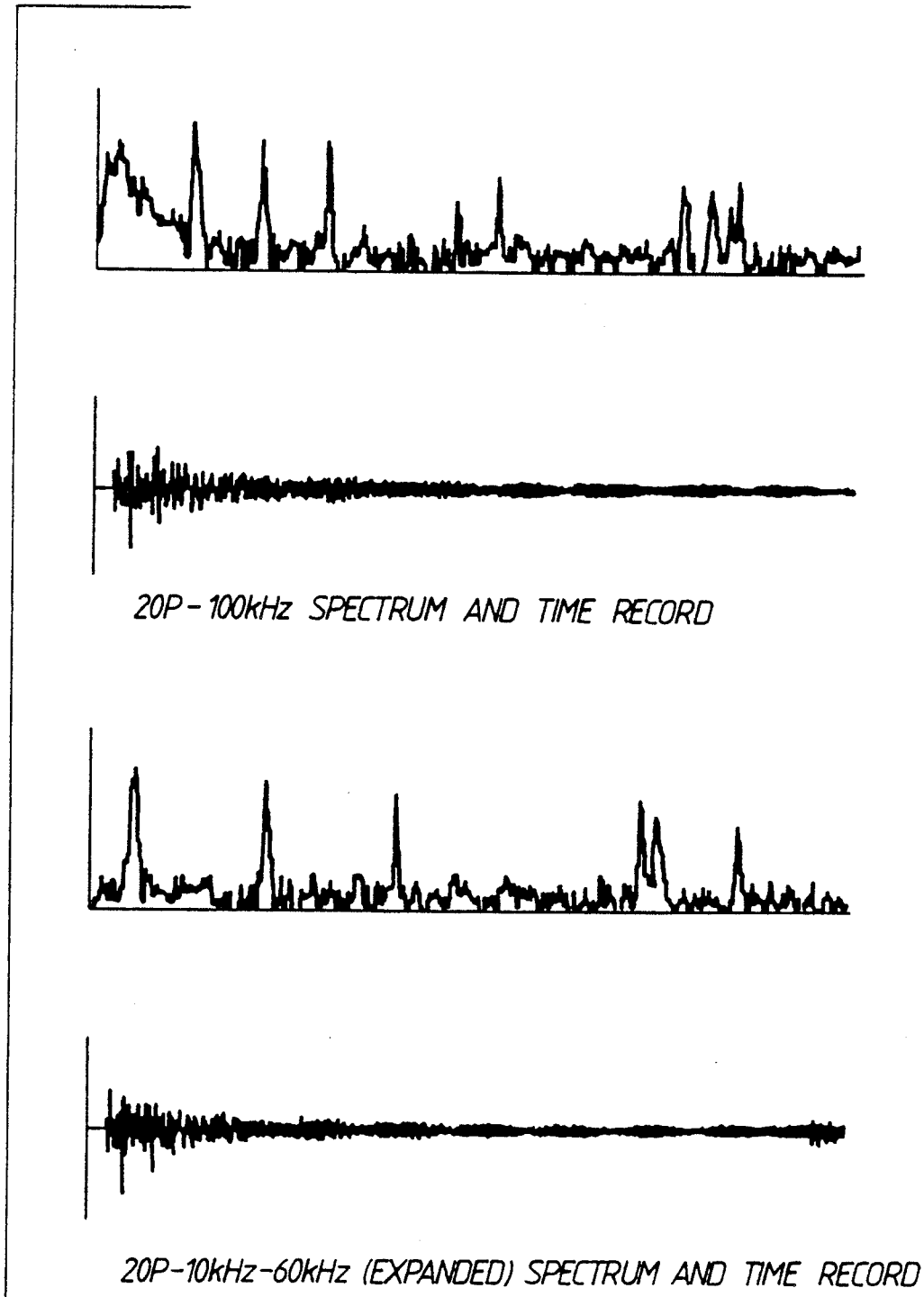
Figure 7:
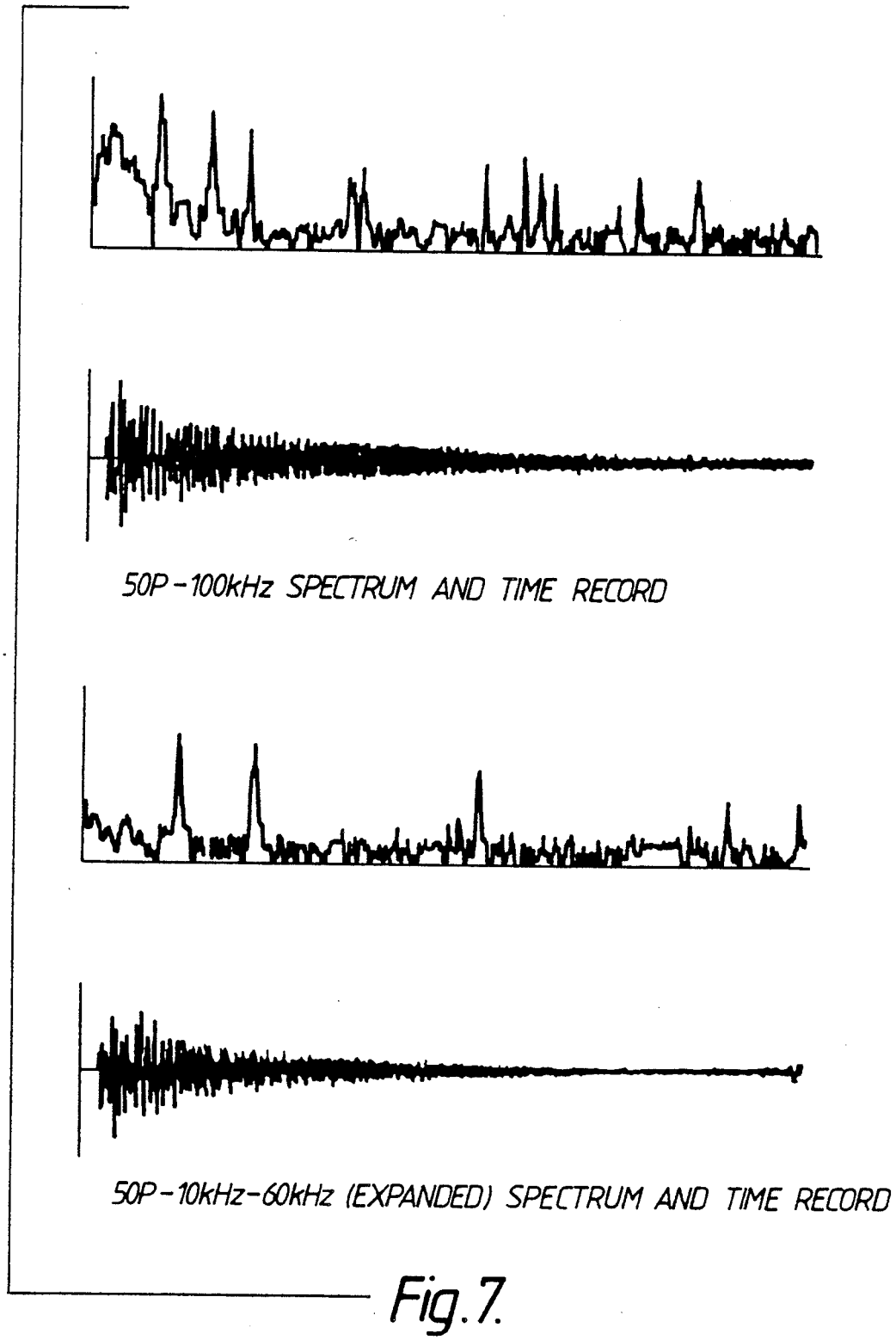
Figure 8:
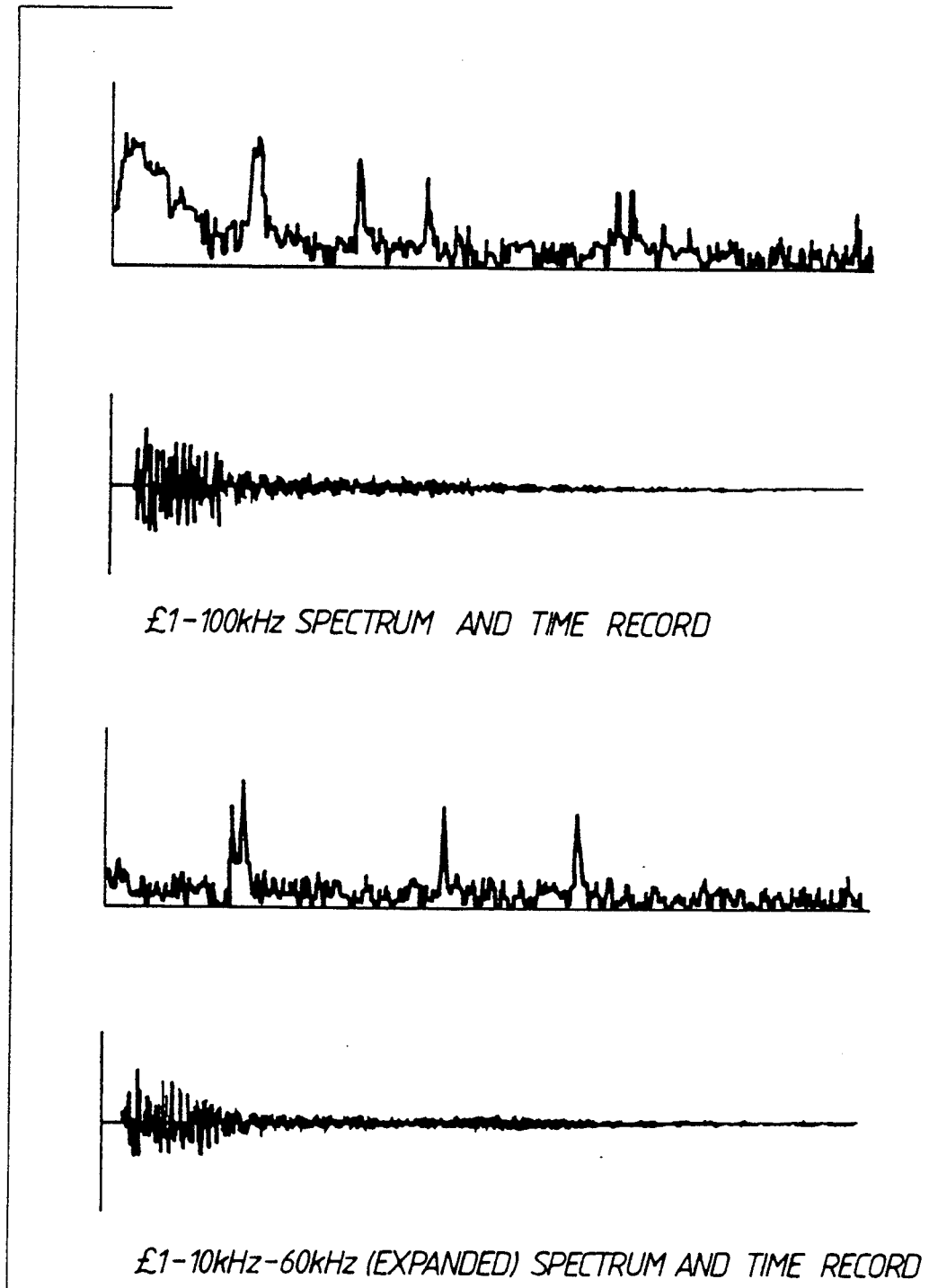
Figure 10:
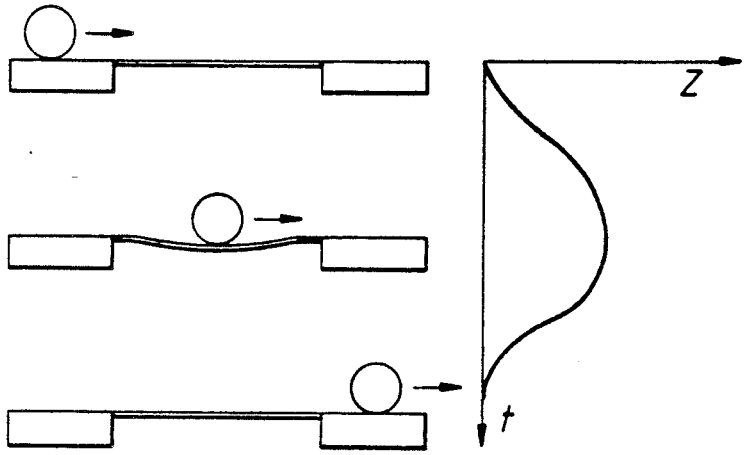
Figure 11:
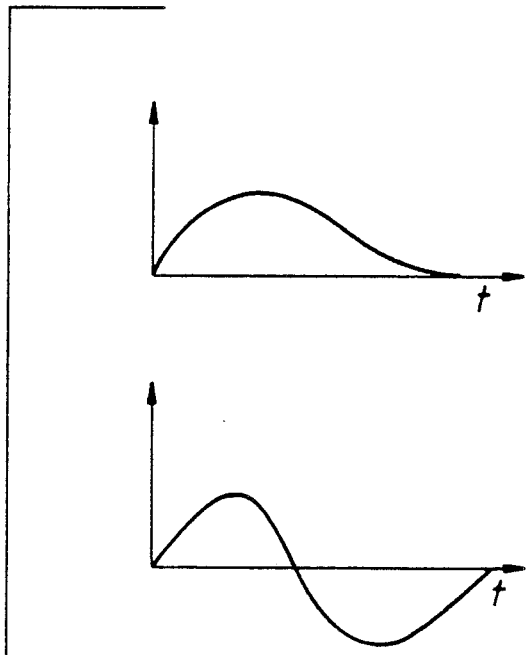
Figure 12:
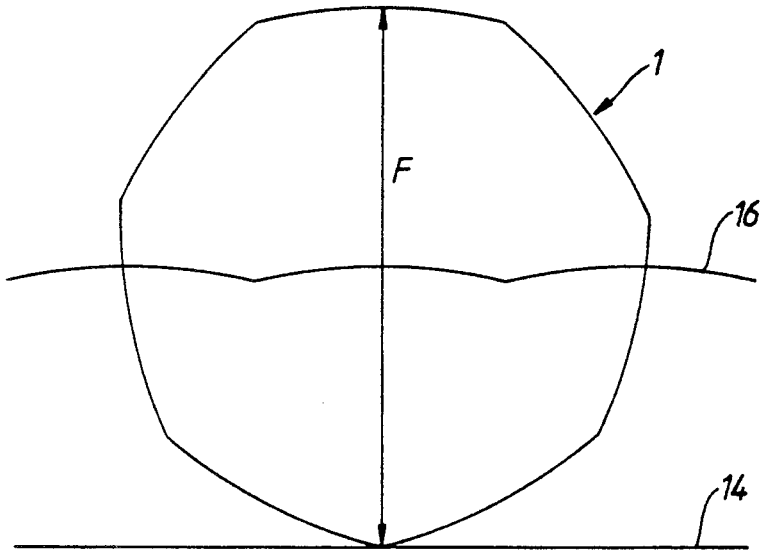
Figure 13:
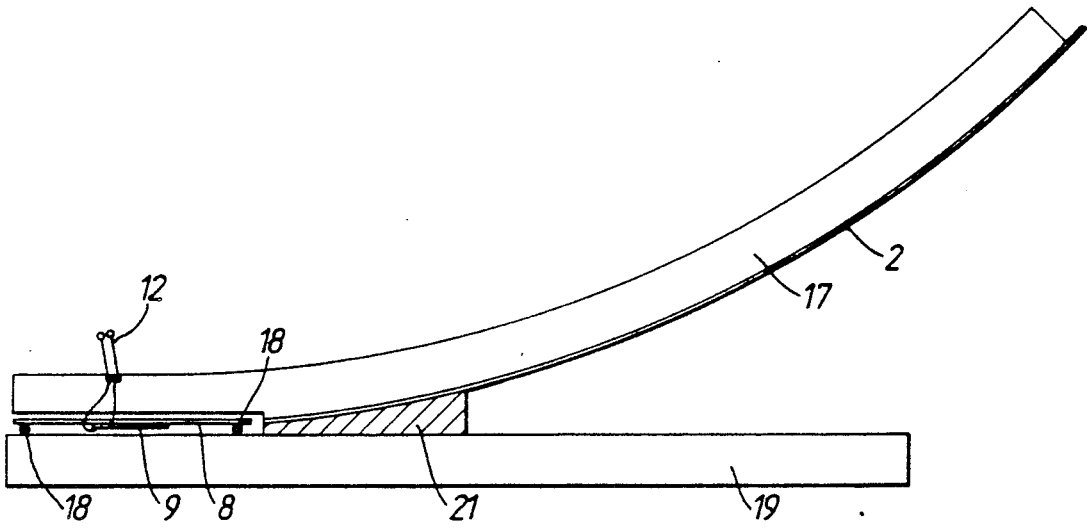
Figure 14A:
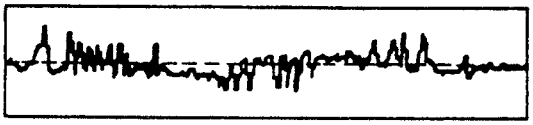
Figure 14B:
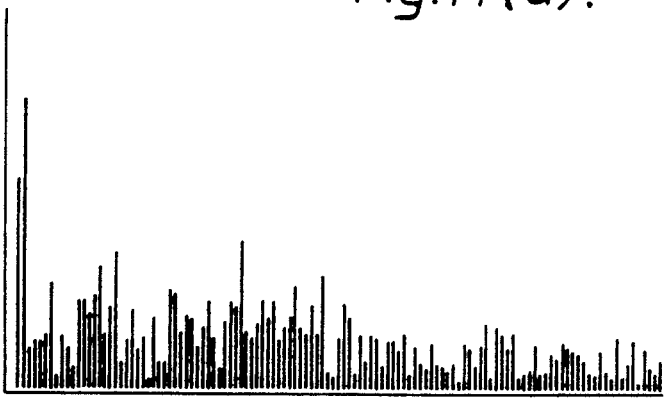
Figure 15A:
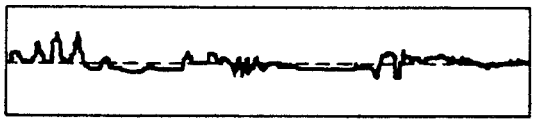
Figure 15B:
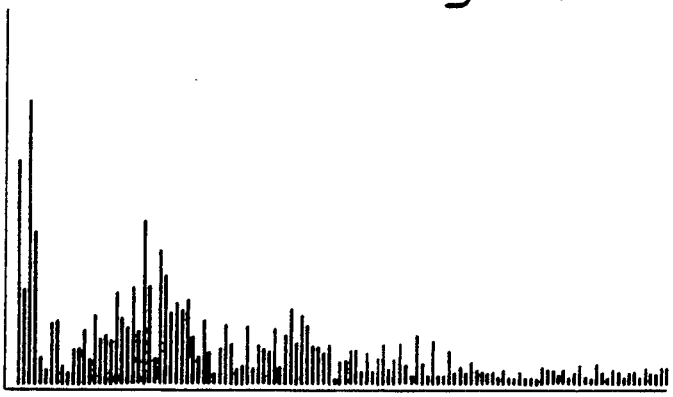
Figure 16:
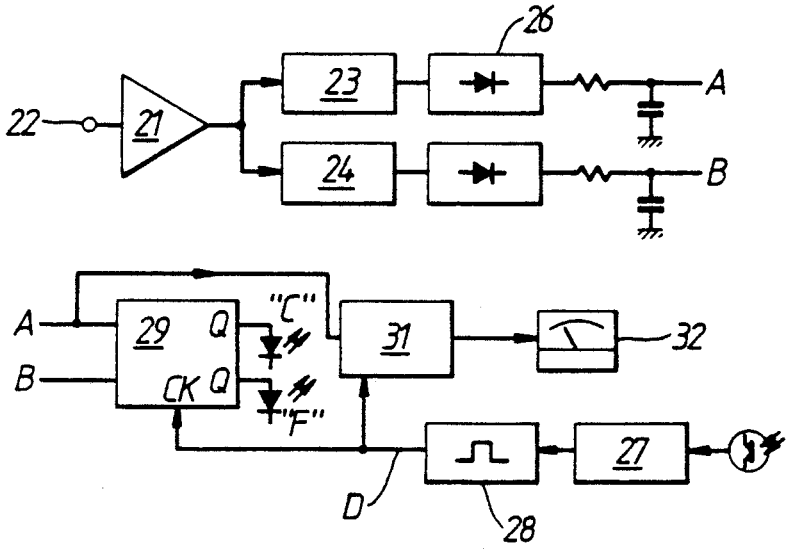
Figure 17:
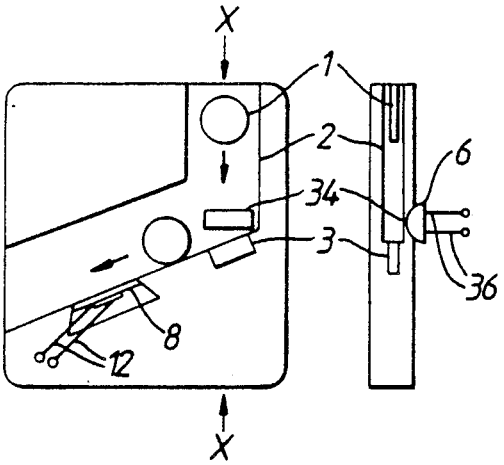
Figure 18:
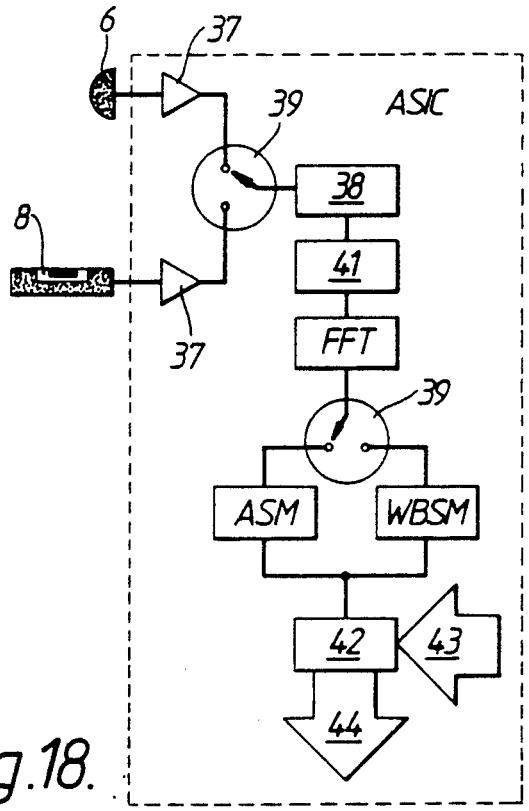

By way of example, some particular embodiments of the invention will now be described with reference to the accompanying drawings, in which:

FIG. 1 shows coin validation apparatus for obtaining the acoustic spectrum emitted by a coin, FIGS. 2 to 8 are graphs which show the time and frequency structure of the sound emitted by the British coins of denomination 1p, 2p, 5p, 10p, 20p, 50p, and £1, respectively, FIG. 9 shows a piezoelectric sensor arrangement capable of producing signals relevant to a coin's shape and weight, FIGS. 10 and 11 illustrate use of the piezoelectric sensor and depict the type of output signal that can be expected, FIG. 12 depicts a fifty pence coin showing the locus of motion of its centre of gravity when subjected to a rolling movement, FIG. 13 shows a chute arrangement for leading the coin to the piezoelectric sensor, FIGS. 14*a* and 14*b* show the voltage signal obtainable from the piezoelectric sensor when a ten pence coin is rolled over the sensor, FIGS. 15*a* and 15*b* show similar results for the fifty pence coin, FIG. 16 is a circuit diagram depicting a simple electrical circuit for distinguishing between the ten pence and fifty pence coins, FIG. 17 shows the mechanical parts of a coin validation apparatus, and, FIG. 18 gives a block diagram of the associated electrical circuit.

When a coin is struck against a hard object, it will vibrate with a characteristic set of modes, determined by the metal from which it is made and the dimensions (thickness, diameter if the coin is circular and any other dimensional features, such as the presence of facets, holes or regions of differing composition). The sound emitted by the coin will contain information about these resonant modes, whose relative amplitudes will change with time after the coin has been struck. FIG. 1 shows an apparatus which can be used to obtain the acoustic spectrum emitted by a coin. The coin 1 is allowed to drop down a chute 2 to strike a resilient plate where it emits sound. The sound emitted 4 is detected by a microphone 6, which can be a device such as a Bruel and Kjaer 4135 or any other microphone type which will cover the frequency band containing the modes of interest (the lowest frequency is likely to be around 10 KHz, the highest between 40 and 100 KHz). The signal from the microphone is amplified, recorded and analysed. One particularly suitable microphone for this is a device using the piezoelectric plastics material PVDF.

FIGS. 2 to 8 show the time and frequency structure of the sound emitted by the British coins of denomination 1p, 2p, 5p, 10p, 20p, 50p, and £1. These spectra were obtained by analysing the acoustic signals using a Hewlett Packard HP3561A Dynamic Signal Analyser and are displayed in the figures over the ranges zero to 100 KHz and zero to 60 KHz. Each spectrum was obtained by carrying out a Fourier transform of the acoustic spectrum collected in a four millisecond interval of time approximately eight milliseconds after the coin had struck the inclined plate 3 in FIG. 1. It was not found necessary to let the coin travel freely through the air adjacent the microphone in order to be able to collect the acoustic spectrum. Furthermore, it was found that the relative amplitudes of the peaks in the acoustic spectrum from a given coin changed markedly with time as the damping of the different modes of vibration is different.

The peaks in the acoustic spectra are characteristic of the coin denomination and Table 1 lists the frequency bands up to 50 KHz in which major and minor resonant peaks of these spectra occur for the United Kingdom coin set.

TABLE 1

| Denomination Frequency Band | 5 p | 10 p | 20 p | 50 p | 1 |
|---|---|---|---|---|---|
| 9.4–9.8 | | B | | A | |
| 9.9–10.5 | A | A | | A | |
| 12.8–13.2 | | | A | | |
| 16.8–17.2 | | A | | A | |
| 17.9–18.8 | A | | | | A |
| 18.8–19.5 | | | | | A |
| 21.6–21.8 | | | A | | |
| 21.9–22.0 | | | | A | |
| 22.1–22.4 | | A | | | |
| 23.9–24.1 | A | | | | |
| 29.9–30.3 | | | A | | |
| 31.1–31.3 | | | | B | |
| 31.6–33.0 | | | | | A |
| 35.4–35.9 | | | | B | |
| 36.0–36.5 | | | | B | |
| 37.5–38.4 | | B | | A | |
| 39.3–39.4 | A | | | | |
| 40.8–42.1 | A | | | | A |
| 46.3–46.6 | | | B | | |
| 47.1–47.5 | | | A | | |
| 48.9–49.0 | | | | A | |
| 49.1–49.2 | | A | | | |

"A" indicates a clear resonant peak
"B" indicates a secondary peak, or variation between coins of the same denomination but of different dates.

Close inspection of the spectra reveals that there are very significant differences between most coins, so that it is possible to obtain good discrimination between most of these coin denominations on the basis of the acoustic signature alone. However, certain coin denominations produce similar spectra, the differences between them being quite subtle. For example, the signals obtained from the ten pence and fifty pence coins correspond very closely. This is because the two coins are made from the same metal (cupro-nickel) and are very similar in linear dimensions, the major difference between the two coins being that the ten pence coin is circular with a diameter of 28.35 millimeters while the fifty pence coin possesses seven rounded facets, with a radius of 29.95 millimeters, as shown by the dimension F in FIG. 12. The precise frequencies in kilohertz of all the major peaks in the spectra of the fifty pence and ten pence coins are given in Table 2.

TABLE 2

| 50 p | 10 p | |
|---|---|---|
| 10.08 | 10.08 | |
| 12.28 | 12.28 | |
| 17.10 | 17.11 | |
| 19.39 | 19.30 | |
| 22.10 | 22.37 | |
| 36.40 | 37.71 | (Broad Peak) |
| 39.04 | | |
| 55.26* | 56.32* | |
| 58.07 | 57.90 | |
| 61.23 | 60.53 | |
| 64.91* | 65.70* | |
| | 66.75 | |
| 76.32 | 75.88 | |
| 77.19 | 76.75 | |
| 85.09* | | |
| 96.49 | 96.49 | |

The only peaks which could be used for discrimination are marked with an asterisk. It can be seen that, in order to discriminate between these two coin types by the acoustic signature alone, it would be necessary to analyse the signature of the coin at frequencies up to 100 KHz, with a frequency resolution of better than 0.5 KHz. Whilst this is possible, the task of carrying out the signal analysis by, for example, fast Fourier transformation (FFT) becomes increasingly difficult as the upper frequency and the frequency resolution increase. This is because it is necessary to digitally sample the signal at a frequency which is at least twice that of the highest frequency required and for a time which is the inverse of the minimum resolved frequency. Hence, to achieve the above maximum frequency ($f_{max}$) of 100 KHz at 0.5 KHz resolution ($f_{res}$) would require the use of a 200 KHz sampling rate for a total sample time of two milliseconds. As the time taken to perform a FFT depends on the number of data points, reducing $f_{max}$ and increasing $f_{res}$ makes the process both faster and cheaper. It can be seen from this that it can be beneficial to incorporate some further characteristic of the coin into the discrimination analysis.

One possibility would be to use an optical technique to measure the coin diameter and to compare positions of the peaks in the coin spectrum with those in a library set for coins of a given diameter.

This has been described by other workers who have used a photodiode array to measure the coin diameter. However, this technique is likely to be confused by coins which are not circular, as the measured diameter would depend upon the attitude with which the coin fell past the measuring apparatus. Also, such a technique would still have considerable difficulty in distinguishing between the ten pence and fifty pence coins, as the mean diameter of the latter is very similar to that of the former. Furthermore, the use of such an optical technique depends upon having a source of light within the apparatus, the generation of which would consume electrical power, a factor which can be a disadvantage for certain application areas. An apparatus will now be described which provides a second characteristic signal which is dependent upon the peripheral shape and the weight of the coin for use in conjunction with an acoustic characteristic signal in the coin validation process.

FIG. 9 shows a schematic diagram of a piezoelectric sensor device which can be used to obtain the signal characteristic of the coin's shape and weight. This device can be called a "piezoelectric weigh-bridge". The coin 1 under test is allowed to roll along an inclined plane 7 which is an integral part of the coin validation apparatus. At some point along its length, the plane consists of a flexible strip 8 suspended over a cavity so that the strip can bend as the coin rolls over it. This strip can be made of metal or plastics material, such as spring steel, phosphor bronze, perspex or any other material which will give a deflection when the coin rolls over it. Bonded to the rear face of the strip 8 is a piece of piezoelectric material 9 which will give an electrical signal when it is placed under tension or compression. Suitable materials for this are: piezoelectric ceramics such as those in the lead zirconate titanate series, for example. PZT-5A, PZT-5H, PZT-4, PZT-8 (these are well known to those skilled in the art of using piezoelectric materials) or barium titanate; single crystal materials such as lithium niobate or lithium tantalate; and polymers such as polyvinylidene fluoride or vinylidene fluoride-trifluoroethylene copolymers. The piezoelectric sensor 9 is bonded to the flexible strip using soldering or an adhesive bond such as an epoxy resin or cyanoacrylate material. The piezoelectric sensor is provided with conductive electrodes 11 such as a silver or aluminium film which can be used to sense the electrical signals produced when the piezoelectric material is placed under tension or compression. The electrical signals so produced are conducted to an electronic sensing system via connecting leads 12, one of which is taken to earth and the other provides an input to an amplifier. The space between the piezoelectric element and the inclined plane is filled with a damping medium 13 which has the function of damping any flexural resonances of the flexible strip/piezoelectric sensor combination, and which can otherwise interfere with the signal due to the coin. Suitable damping media are silicone greases (such as those supplied by Dow Corning) or silicone gels or rubbers. Other thick hydrocarbon-based greases or natural or synthetic rubbers are also likely to be suitable for this purpose.

The mode of operation of this piezoelectric weigh-bridge will now be described. FIG. 10 shows the displacement z of the composite strip as a circular coin is allowed to roll over it. The displacement is at a maximum when the coin is approximately over the centre of the strip. The charge Q generated by the piezoelectric sensor is proportional to z. The voltage generated by the sensor as a function of time t will depend upon the input impedance R of the amplifier into which the signal from the piezoelectric sensor is fed. If the impedance is high so that the product RC (where C is the capacitance of the piezoelectric sensor) is large in comparison with the time taken for the coin to roll over the strip, then the voltage generated will be proportional to z. If RC is small compared with this time, then the voltage output will be proportional to dz/dt. These two functions are sketched in FIG. 11 for a circular coin.

The displacement z will be dependent on the weight of the coin and also its shape. For example, if the coin is facetted, as for the British fifty pence and twenty pence pieces, then the centre of gravity of the coin will be raised and lowered as the coin rolls over the corners. FIG. 12 shows the locus of the motion of the centre of gravity for a fifty pence coin 1 as it rolls along a plane 14, the locus of motion of the centre of gravity being shown by the line 16. As this happens, there is a varying force applied to the piezoelectric weigh-bridge, the precise character of which will depend upon the shape of the coin (that is, the number of facets, their geometry and its average diameter), the weight of the coin and the velocity with which it rolls over the bridge.

Thus, the signal which comes from the piezoelectric weigh-bridge contains a number of components: a low frequency component which is dependent upon the weight of the coin, and higher frequency components which are present if the coin is facetted and which contain information about the precise shape of the coin.

FIG. 13 shows a particular embodiment of this invention. This embodiment comprises a chute 2 with parallel guides 17 for delivering the coins to the weigh-bridge, which consists of a glass microscope slide 8 to which is adhesively secured a PZT-5H disc 9 bearing electrodes of a fired-on silver paste. The disc 9 had a diameter of 23 millimeters and thickness 0.8 millimeter, with a capacitance of 17.6 nF. The ends of the glass slide were supported by lengths of one millimeter diameter tubing 18 and the end of the chute was separated from the weigh-bridge by a gap of about 0.2 millimeters. The voltage signal from the piezoelectric disc being taken by two wires 12 connected to the silver electrodes of said disc by means of a solder bond. The whole structure was supported on a base 19 made of wood by an epoxy resin block 21.

FIG. 14 illustrates the voltage signal which is obtained from the weigh-bridge when a ten pence coin is rolled over it. FIG. **14*a* shows the voltage output on the vertical axis as a function of time while FIG. 14*b* shows its Fourier transform, giving the strength of the signal in intervals of 10 Hz. It can be seen that there is a significant amount of high frequency noise which can be attributed to the coin bouncing as it rolls across the bridge. In spite of this, the spectral analysis shows information relating to the weight and the shape of the coin. The major single low frequency peak at about 10 to 20 Hz is found to be characteristic of the circular coins and corresponds to the loading and unloading of the weigh-bridge as the coin rolls over it. FIGS. 15*a* and 15*b*** shows the voltage signal and frequency spectrum which is obtained from a fifty pence piece. The fifty pence coin spectrum exhibits a second major peak at about 40 Hz corresponding to the signal from the shifting centre of gravity of the coin as the coin rolls over each corner. It is generally found that all of the facetted coins show the higher frequency peak as well as the lower frequency one. It is therefore possible to analyse this signal to give information about the weight and shape of the coin.

FIG. 16 shows a simple circuit which can be used for analysing the signal. It consists of an amplifier 21 which amplifies the signal from the piezoelectric sensor on the weigh-bridge which is applied to an input terminal 22. The output from the amplifier is passed to a first filter 23 which filters from DC to 10 Hz and a second narrow-band filter 24 at 40 Hz. The outputs from these filters are delivered to precision rectifiers 26 and integrated to give two signals, a low frequency signal component (A), which is dependent upon the coin weight and a high frequency component (B) which contains the information about the shape of the coin (that is, whether or not it is facetted). The weigh-bridge is also provided with some means for assessing whether or not a coin is present. In the example given here, this is an optical sensor consisting of a light emitting diode on one side of the coin track and a photodiode on the other side. When the coin passes between these, the interruption of the light beam is used to generate an electrical signal (C) to trigger by means of an optotrigger 27 the monostable 28, which provides a pulse (D). It will be appreciated that the trigger signal could equally well be generated in alternative ways, for example, by using the microphone for the detection of the acoustic signal, or by using an electromagnetic sensor. The two signals (A), (B) and (D) are passed to a latched comparator 29. If signals (A) and (D) are present, then the coin is circular and the comparator 29 provides an output Q. If signals (A), (B) and (D) are all present, then the coin is facetted and the comparator 29 provides an output $\overline{Q}$. It will be appreciated that the outputs Q and $\overline{Q}$ can be used to operate other circuits, but in this case they are simply used to illuminate indicator lamps. The signal (A), which contains the information about the coin weight is passed to a sample and hold circuit 31, which is driven by the signal (D). The hold output from the circuit 31 is dependent upon the coin weight and can be used to drive a meter 32 or other indicator or be used in following coin validation circuits as indicated below.

A complete coin validation apparatus using both the acoustic signals and the piezoelectric weigh-bridge will now be described. The mechanical configuration is shown in FIG. 17. The right hand side portion of FIG. 17 is a cross-sectional view taken along the line X—X. The body 33 of the validation apparatus is made from a plastics metal or any other hard material which can be shaped. Machined into the body is a slot or chute 2 which consists of a substantially vertical portion and an inclined portion. Directly beneath the vertical portion is a plate 3 of some hard material such as an alumina ceramic or other oxide ceramic or a metal such as steel. This plate acts as a snubber against which a coin 1 dropped into the vertical portion of the chute 2 will strike. The plate 3 is mounted so that it is substantially flush with the inclined portion of the chute 2. Mounted in the wall of the vertical portion of the chute adjacent to the plate 3 is an aperture or grille 34, behind which is situated a microphone 6 with the appropriate characteristics. Leads 36 connect this microphone with the following electronics. Mounted in the inclined portion of the chute and flush with the inclined surface is a piezoelectric weigh-bridge 8. Leads 12 connect the output from the piezoelectric sensor on this to the following electronics. When a coin 1 is dropped into the validation apparatus chute 2, it first strikes the plate 3 and the sound emitted by the coin is detected by the microphone 6. The coin 1 then rolls down the inclined portion of the chute 2 and over the piezoelectric weigh-bridge 8. The electrical signals from the microphone 6 and weigh-bridge 8 are used by the following electronics to validate the coin.

The signals produced by the microphone 6 and piezoelectric weigh-bridge 8 are first amplified and then passed to the validation circuit for analysis. The sound emitted by the coin 1 can either be analysed in the frequency or the time domain. Frequency domain analysis can be carried out in a variety of ways. In the circuit shown in FIG. 18, the acoustic signal is first amplified by passage through a preamplifier 37 and then passed through a software-controlled switch to an analogue to digital convertor 38 which digitises the signal. The circuit includes two software-controlled switches 39. The digitised sample is stored in a memory 41. The time domain sample is then converted to a frequency domain spectrum using a fast-Fourier transform circuit (FFT). The strength of the signal ($S_1$, $S_2 \ldots S_i$) is recorded in a set of specified frequency bands ($f_1$, $f_2 \ldots f_i$), preselected on the basis of measurements on the set of coins to be tested for and the strengths of these signals are stored in an acoustic spectrum memory (ASM). These preselected bands were chosen to coincide with the peaks in the spectra due to the vibrational modes, as given in Table 1 for the UK coin set. The software controlling the system then redirects the input to take the signal from the weigh-bridge 8. This new signal is digitised by the same analogue-to-digital convertor 39 and the digitised signal stored in the memory 41. The same FFT circuit is used to convert the weigh-bridge signal into frequency space and the strength of signal ($W_1$, $W_2 \ldots W_i$) in each of a new set of frequency bands ($f'_1$, $f'_2 \ldots f'_i$) stored in a weigh-bridge spectrum memory (WBSM). The frequency band $f_i$ will be chosen to include the bands containing the weight and facet signals from the coin, together with any other information which may be present in the spectrum such as signals due to the presence of milling on the edge of the coin. The $S_i$ and $W_i$ form the feature vector components which can be used in a Bayes Classifier (a technique which is well known to those skilled in the art of pattern recognition) for comparison with a reference classification vector. This classification is carried out by a classification algorithm 42 part of the circuit which would take as input data the details of the reference classification vector. Input data for the classification algorithm 42 is supplied on the line 43 and there are output lines 44 to selection logic devices.

The electronic devices for carrying out these system functions can be provided as separate circuit elements or they can all be integrated into a single application specific integrated circuit (ASIC) as shown by the dotted line area in FIG. 18.

It will be appreciated that alternative circuits could be used for conducting this system function. For example, the acoustic signal can be passed through a filter bank, preset at the frequencies $f_i$, with the level of signal passing through each filter giving the values of $S_i$. Alternatively, a single tuneable filter can be used which is tuned through the set of $f_i$ sequentially. As a further alternative, the acoustic signal can be mixed with a local oscillator signal, which can be tuned and subsequently passed through a filter of fixed frequency. Tuning the local oscillator frequency and monitoring the signal passing through the filter permits a measurement of the signal strength in each of the frequencies $f_i$.

Alternative methods for forming the feature vector components from the acoustic signal include that of examining the signal in the time domain, looking at the times between each point at which the measured signal crosses through the zero level.

The coin identification is performed by comparing the feature vector with a reference vector determined on a large set of the coins against which the unknown coin is to be classified. This can be done using any of the standard techniques of classification, such as the Bayes linear or quadratic classifiers. It will be appreciated that alternative systems can be used to act upon the same information. For example, the peaks in the frequency spectrum and the weigh-bridge spectrum can be isolated in frequency and amplitude and these can be compared with library values in ways other than that of the Bayes Classifier. It is evident that this would not be a fundamentally different method as it is making use of the same information in combination.

The result of the classification operation is used to drive a set of signal lines to predetermined logic levels to pass the information on the classification and enable another electronic or electrical system to operate.

The foregoing description of an embodiment of the invention has been given by way of example only and a number of modifications may be made without departing from the scope of the invention as defined in the appended claims. For instance, the coin validation apparatus is not restricted to use with the coins of the United Kingdom coin set and it should be capable of identifying the coins of any other coin set.

In one refinement, the operating electronics may be triggered into operation when necessary in order to exclude unwanted signals and to give power economy. This may be effected by using the microphone to detect the first impact of the coin against the snubber, and the resulting impulse can be used to trigger the following electronics. An optical sensor can be provided such that a light emitter is placed on one side of the chute and a detector on the other side. This will ensure that the light beam is interrupted just before the coin impacts against the snubber. A piezoelectric element can be attached to the snubber such that the mechanical impact of the coin generates an electrical impulse which is used to trigger the following electronics. An electromagnetic sensor can be provided consisting of a permanent magnet and concentric coil situated adjacent the chute such that the falling coin in the vertical portion of the chute passes it immediately before striking the snubber. The eddy currents generated in the coin will induce an electric current in the coil which can be used to trigger the following electronics.

As a further refinement of the validation apparatus, the walls of the chute can be lined with an acoustically dead material in order to reduce unwanted sounds due to the coin rubbing or rattling against them. Suitable materials for this purpose include plastics foam sheeting, real or artificial leather, cardboard and paper.

We claim:

1. Coin validation apparatus comprising a coin chute including a hard striking surface upon which a coin entering the apparatus is directed, a microphone positioned to detect acoustic vibrations of the coin after striking said surface, an output from said microphone being applied to signal processor means to produce a dynamic signal analysis of the coin vibrations, weighbridge measuring apparatus comprising a flexible strip of resilient material which is carried on a support at each end, guide means for permitting the said coin to be rolled along the whole length of the strip thereby causing a temporary deflection of a centre portion of said strip, and a strain gauge located at the strip centre portion effective to produce an electrical signal representative of the deflection which is induced in the strip, comparison means for enabling the resulting vibration spectrum and electrical signal to be compared with stored data representative of a set of standard coins, and output means arranged to indicate which coin value of the expected set has entered the apparatus.

2. Apparatus as claimed in claim 1, in which the said strain gauge is a piezoelectric sensor.

3. Apparatus as claimed in claim 1 or 2, in which the two strip supports are located at opposite ends of an enclosure defining a cavity having a sufficient depth to accommodate the said strain gauge.

4. Apparatus as claimed in claim 3, in which the said cavity contains a mechanical damping medium arranged to reduce unwanted flexural resonances in said strip.

5. Apparatus as claimed in claim 4, in which the said damping medium is a a material selected from a group of materials comprising a grease, a gel and a rubber.

6. Coin validation apparatus comprising:

a coin chute for receiving coins inserted into the apparatus;

a striking surface positioned relative to the coin chute so that a coin moving through the chute strikes the striking surface and emits acoustic vibrations;

a microphone positioned to detect said acoustic vibrations, and to provide an electrical output signal;

frequency responsive means for receiving said electrical output and determining the relative strength of the output signal in each of a series of predetermined frequency bands and to provide outputs indicative thereof;

weighbridge means spaced from said striking surface and positioned for permitting said coin to roll over the weighbridge while the weighbridge means measures additional parameters of said coin, the weighbridge means providing a further electrical output signal;

processing means for processing said further electrical output signal to derive desired information therefrom; and classifier means coupled to receive said desired information and said outputs from said frequency responsive means, said classifier means including memory means storing data representative of each coin type of a set of coins, and means for comparing the stored data with said desired information and said outputs from the frequency responsive means in order to classify said coin as one of the coin types, wherein the weighbridge means comprises a strip of deflectable material, mounting means for securing each end of the strip, and strain gauge means associated with the strip whereby when a coin rolls over the strip, deflection thereof causes said strain gauge to provide said further electrical output signal.

7. Coin validation apparatus as claimed in claim 6 wherein said frequency responsive means comprises fast fourier transform means.

8. Coin validation apparatus as claimed in claim 6 wherein said weighbridge means is positioned downstream of said striking surface, an inclined surface being interposed between the striking surface and the weighbridge means to permit the coin to roll over the weighbridge means without bouncing.

9. Coin validation apparatus as claimed in claim 6 wherein said processing means comprises means for deriving from said further electrical signal a signal representative of the weight of the coin and means for deriving a signal representative of peaks in said further electrical output signal indicative of facetting in the coin shape.

10. Coin validation apparatus as claimed in claim 6 wherein the strain gauge means comprises a piezoelectric sensor which is mounted to the strip at a centre point thereof.

11. Coin validation apparatus as claimed in claim 6 wherein said deflectable material is selected from one a set of materials comprising spring steel, phosphor bronze, perspex or glass.

* * * * *